US007216574B2

(12) United States Patent
Woods

(10) Patent No.: US 7,216,574 B2
(45) Date of Patent: May 15, 2007

(54) FOOD SLICING APPARATUS

(76) Inventor: Charles A. Woods, 20 Sheppard Road, Oakville, Ontario (CA) L8L 2E2

( * ) Notice: Subject to any disclaimer, the term of this patent is extended or adjusted under 35 U.S.C. 154(b) by 374 days.

(21) Appl. No.: 10/830,029

(22) Filed: Apr. 23, 2004

(65) Prior Publication Data

US 2004/0211306 A1 Oct. 28, 2004

Related U.S. Application Data

(60) Provisional application No. 60/464,971, filed on Apr. 24, 2003.

(51) Int. Cl.
*B26D 3/30* (2006.01)
*B26D 5/10* (2006.01)

(52) U.S. Cl. ..... 83/397; 83/399; 83/761; 83/932; 30/278

(58) Field of Classification Search ..... 30/114, 30/278, 282, 283, 280, 289; 83/651, 526, 83/932, 761–764, 454, 398, 387–401, DIG. 1; 192/143

See application file for complete search history.

(56) References Cited

U.S. PATENT DOCUMENTS

| | | | | |
|---|---|---|---|---|
| 3,347,296 | A | 10/1967 | Rothman | |
| 4,249,445 | A | 2/1981 | Browning | |
| 4,546,686 | A * | 10/1985 | Losiowski et al. | 83/874 |
| 4,589,206 | A | 5/1986 | Marcoux | |
| 4,747,331 | A | 5/1988 | Policella | |
| 5,577,430 | A | 11/1996 | Gunderson et al. | |
| 5,690,013 | A * | 11/1997 | Kanarek et al. | 83/762 |
| 5,819,629 | A | 10/1998 | Sarich | |
| 5,921,163 | A | 7/1999 | McInnes et al. | |
| 5,924,352 | A | 7/1999 | Lothe | |
| 6,016,734 | A * | 1/2000 | Koch | 83/707 |
| 6,202,529 | B1 | 3/2001 | Hodsdon | |
| 6,244,153 | B1 * | 6/2001 | McInnes et al. | 83/870 |
| 6,474,210 | B1 * | 11/2002 | Nel et al. | 83/768 |
| 2002/0151266 | A1 * | 10/2002 | Kidushim et al. | 452/135 |

* cited by examiner

*Primary Examiner*—Kenneth E. Peterson
*Assistant Examiner*—Phong Nguyen
(74) *Attorney, Agent, or Firm*—Bereskin & Parr

(57) ABSTRACT

This invention relates to a food slicing apparatus, and in particular to an apparatus for slicing bread. The food slicing apparatus of the invention has an enclosure to support the food to be sliced. The enclosure features an access opening through which food can be introduced into the enclosure. A cover for the access opening can be provided, moveable relative to the enclosure from an open position to a closed position. A guide is provided within the enclosure for guiding a blade to slice food supported within the enclosure. A stop is also provided to at least partially obstruct the guide. The cover is connected to at least one of the guide and the stop to displace the guide and the stop relative to one another, so that when the cover is in an open position, the stop at least partially obstructs the guide. In the embodiment disclosed, the stop is connected to the cover and moveable relative to the guide to at least partially obstruct the guide when the cover is in the open position. In this manner, the stop blocks the blade from traveling within the guide when the cover is in an open position.

27 Claims, 6 Drawing Sheets

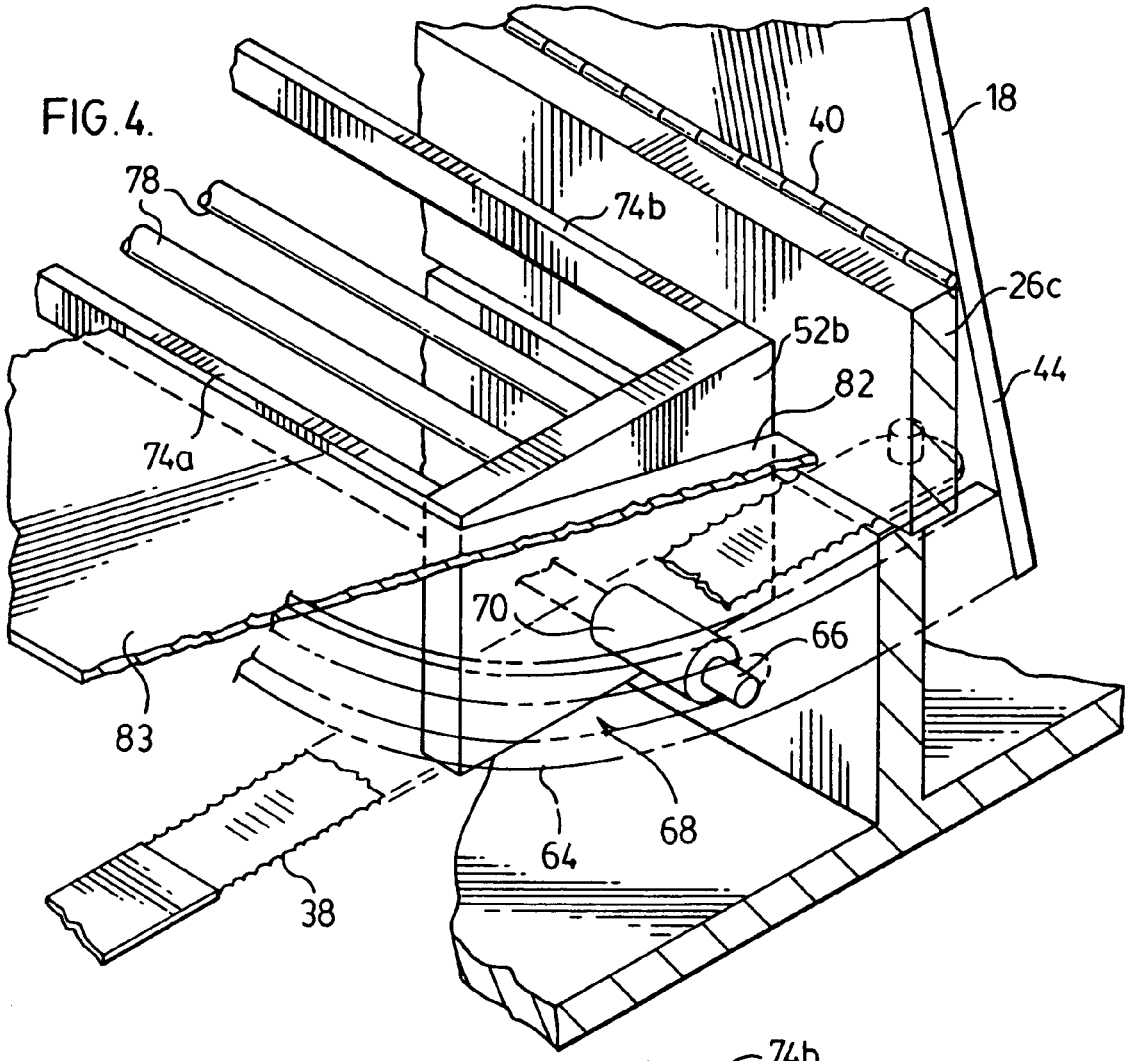
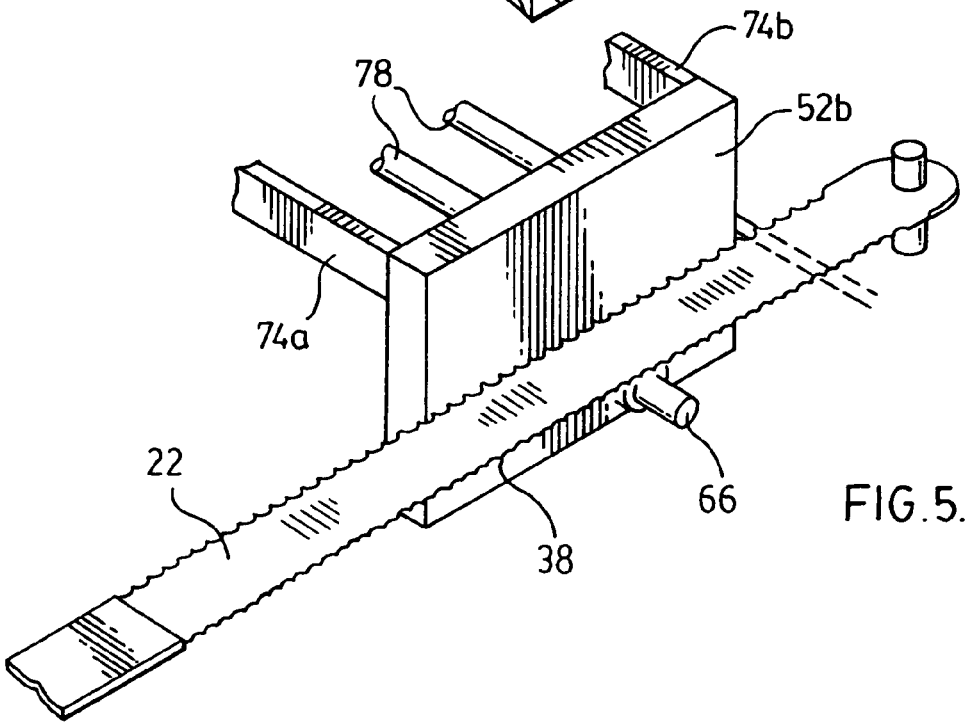
FIG. 5.

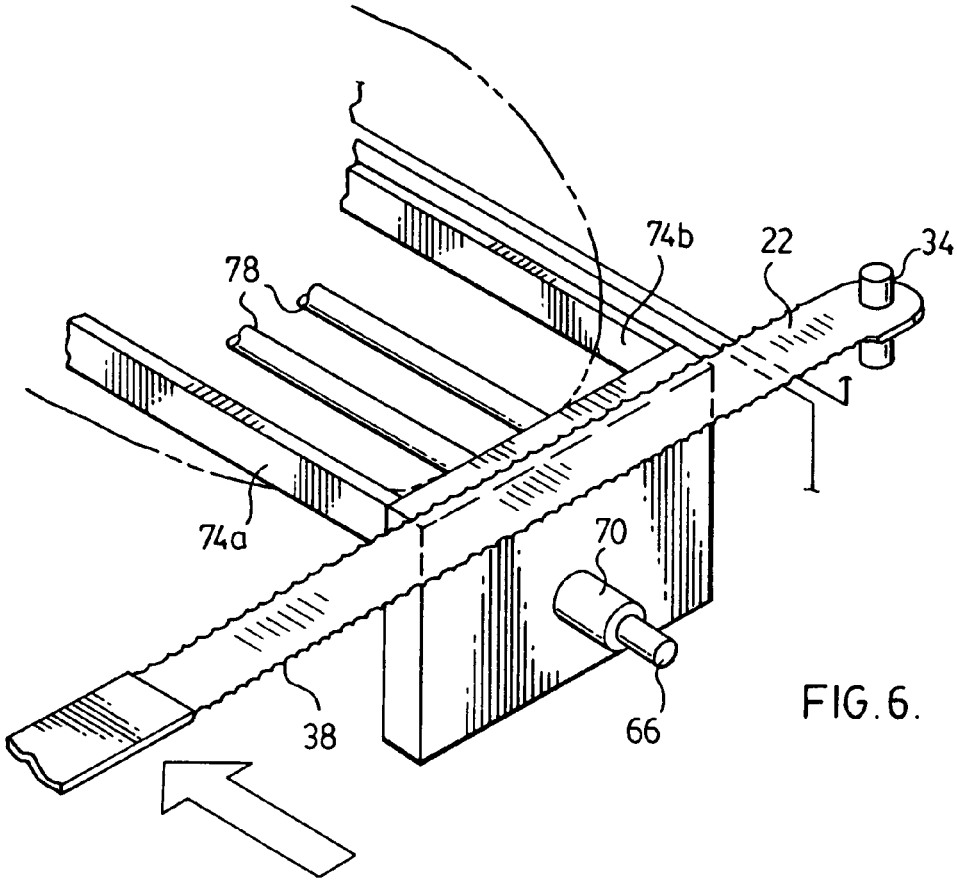
FIG. 6.
FIG. 8.
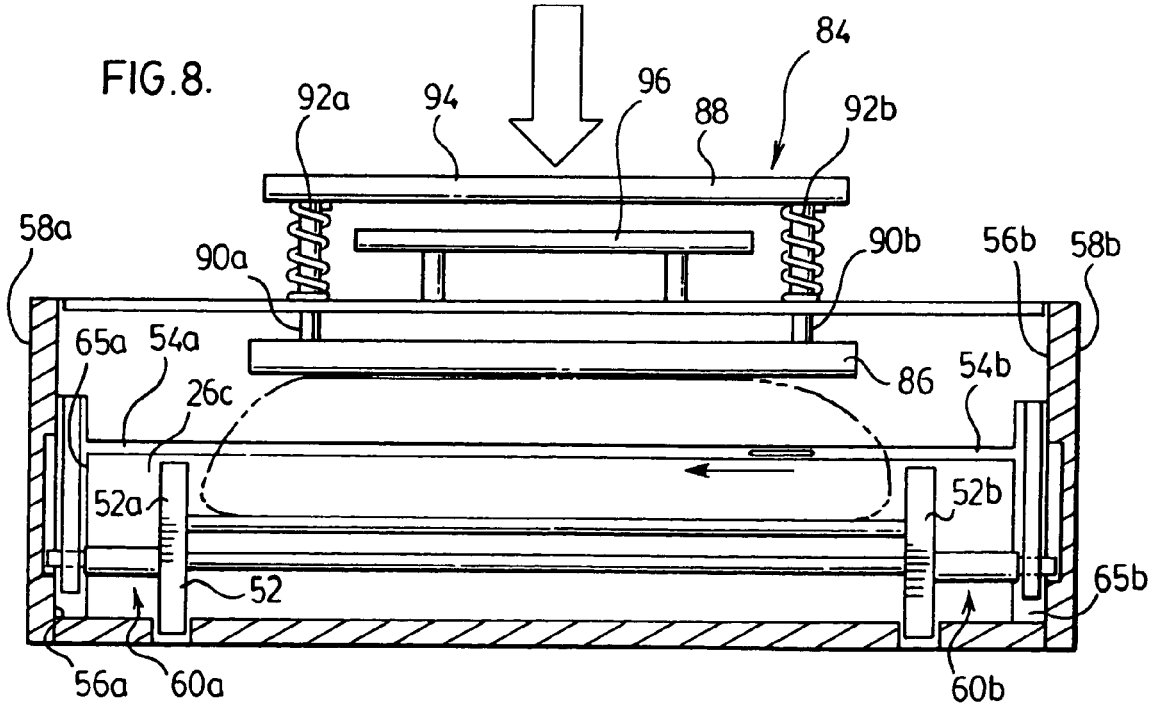

FOOD SLICING APPARATUS

This application claims the benefit of U.S. Provisional Application No. 60/464,971, filed Apr. 24, 2003, the entirety of which is hereby incorporated by reference.

FIELD OF THE INVENTION

This invention relates to a food slicing apparatus. In particular, this invention relates to an apparatus for slicing bread.

BACKGROUND OF THE INVENTION

Food items, such as bread, can be sliced using, for example, a serrated edge or other suitable knife-edge found on a knife. The bread is typically held in place by one hand, usually on a suitable cutting surface, while the other hand wields the knife to slice the bread. It can be appreciated that exposed knife-edges can injure the party slicing the bread. This is of concern in commercial establishments, such as, for example, a diner that serves sandwiches, or submarine sandwich restaurants, where slicing bread has to occur quickly, particularly during peak operation hours, such as, for example, lunch.

SUMMARY OF THE INVENTION

This invention relates to a food slicing apparatus, and particularly to an apparatus for slicing bread. The food slicing apparatus of the invention comprises an enclosure to support the food to be sliced. The enclosure features an access opening through which food can be introduced into the enclosure. A cover for the access opening can be provided, moveable relative to the enclosure from an open position to a closed position.

A guide is provided within the enclosure for guiding a blade to slice food supported within the enclosure. A stop is also provided to at least partially obstruct the guide. The cover is connected to at least one of the guide and the stop to displace the guide and the stop relative to one another, so that when the cover is in an open position, the stop at least partially obstructs the guide. In the embodiment disclosed, the stop is connected to the cover and moveable relative to the guide to at least partially obstruct the guide when the cover is in the open position. In this manner, the stop blocks the blade from traveling within the guide when the cover is in an open position.

The stop can be presented near at least one end of the guide. In the embodiment disclosed the stop is presented near each end of the guide so that two stops are provided. Further, the stop is spaced from an inside wall of the enclosure a sufficient extent to retain the blade between the stop and the wall. It can be appreciated, therefore, that when the cover is open, the blade can be retained between the stop and the inside wall of the enclosure, and the stop blocks the blade from traveling within the guide to the area where the food is supported.

The food slicing apparatus comprises a linkage assembly to connect the stop to the cover. The linkage assembly is a slotted arm, and, for the embodiment disclosed, is a curved slotted arm. The stop presents a pin for sliding within the curved slotted portion of the arm; an end of the arm is connected to the cover.

It is also desirable to provide a food slicing apparatus that cannot be opened when the blade is used to slice food supported within the enclosure. For this aspect of the invention, the food slicing apparatus comprises an enclosure to support the food to be sliced. The enclosure has an access opening and a cover for the access opening. The cover is moveable relative to the enclosure from an open position to a closed position.

A contact surface is provided to engage the blade. The cover is connected to at least one of the contact surfaces and the guide to displace the contact surface and the guide relative to one another so that as the cover is displaced to an open position the contact surface is displaced to at least partially cross the plane that the guide substantially guides the blade within. In the embodiment disclosed, the cover is connected to the contact surface and moveable relative to the guide, so that as the cover is displaced to an open position the contact surface is displaced to at least partially cross the plane of the guide. In this manner, when the blade is in use slicing food and traveling within the guide, the contact surface would engage the blade if the cover was to be opened, thereby stopping or blocking the cover from opening any further.

In a preferred embodiment of the invention, the contact surface is connected to the stop, and, particularly, extends between the stops that are provided near each end of the guide. Moreover, the contact surface is part of a support within the enclosure that supports the food to be sliced. In particular, the support is in the form of a cradle, and the contact surface forms the sides of the cradle. It can be appreciated that in the disclosed embodiment the cradle is bounded along its sides by the contact surfaces, and at each end by the stops.

Moreover, the food slicing apparatus of this invention provides a mechanism for holding the food in place within the enclosure as it is being sliced. In particular, the invention provides for an abutting surface presented within the enclosure and moveable relative to the enclosure to engage at least one side of the food supported within the enclosure. An actuator is presented outside of the enclosure and connected to the abutting surface to displace the abutting surface relative to the enclosure. In the embodiment disclosed, the cover of the apparatus provides for the actuator and the abutting surface. Further, the actuator is a compressible handle, biased to normally present the abutting surface away from where food is supported within the enclosure.

It can also be appreciated that one end of the blade extends outwardly of the enclosure along one side of the guide. This end can be provided with a handle that a user can grasp. The other end of the blade is provided with a blade stop that is displaceable within a channel provided along the other side of the guide. The channel is configured to allow the blade to travel within the guide, and also to allow for limited cutting action. In this manner, the blade is fully operable to slice food, yet is prevented from being removed from the apparatus. Moreover, the channel, the blade stop, and the extent of the knife-edge of the blade can be designed so that as the blade is traveling within the guide to slice food, the knife-edge of the blade is presented entirely within the enclosure.

BRIEF DESCRIPTION OF THE DRAWINGS

For a better understanding of the present invention and to show more clearly how it would be carried into effect, reference will now be made, by way of example, to the accompanying drawings that show a preferred embodiment of the present invention, and in which:

FIG. 4 is an enlarged sectional view showing the interconnection between the support assembly and the cover of the food slicing apparatus;

FIG. 5 is an illustration of the blade abutting the stop of the invention;

FIG. 6 is a view similar to FIG. 5, but with the stop in a lowered position;

FIG. 8 is a cross-sectional view taken along the line 8—8 of FIG. 7.

DETAILED DESCRIPTION OF THE INVENTION

Figure 1:
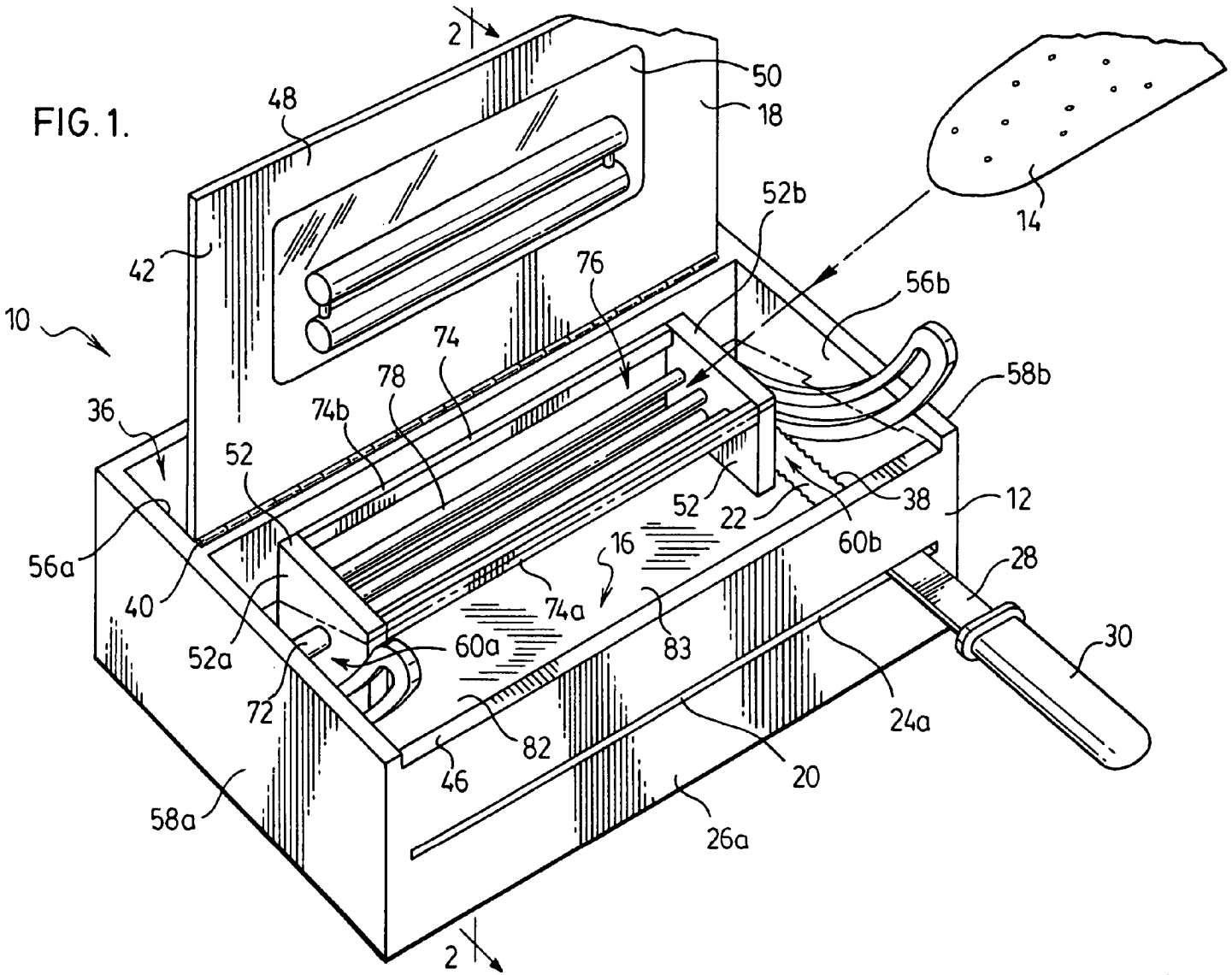
FIG. 1 is a perspective view of the food slicing apparatus of the present invention.

The food slicing apparatus 10 of this invention is illustrated in FIG. 1. Apparatus 10 comprises an enclosure 12 to support food 14 to be sliced. Typically food 14 will be bread, such as, for example, a bun. Enclosure 12 features an access opening 16 through which food 14 can be introduced. A cover 18 for access opening 16 is provided to completely enclose food 14 within the apparatus 10. Cover 18 is moveable relative to enclosure 12 from an open position to a closed position, as will hereinafter be described.

Figure 2:
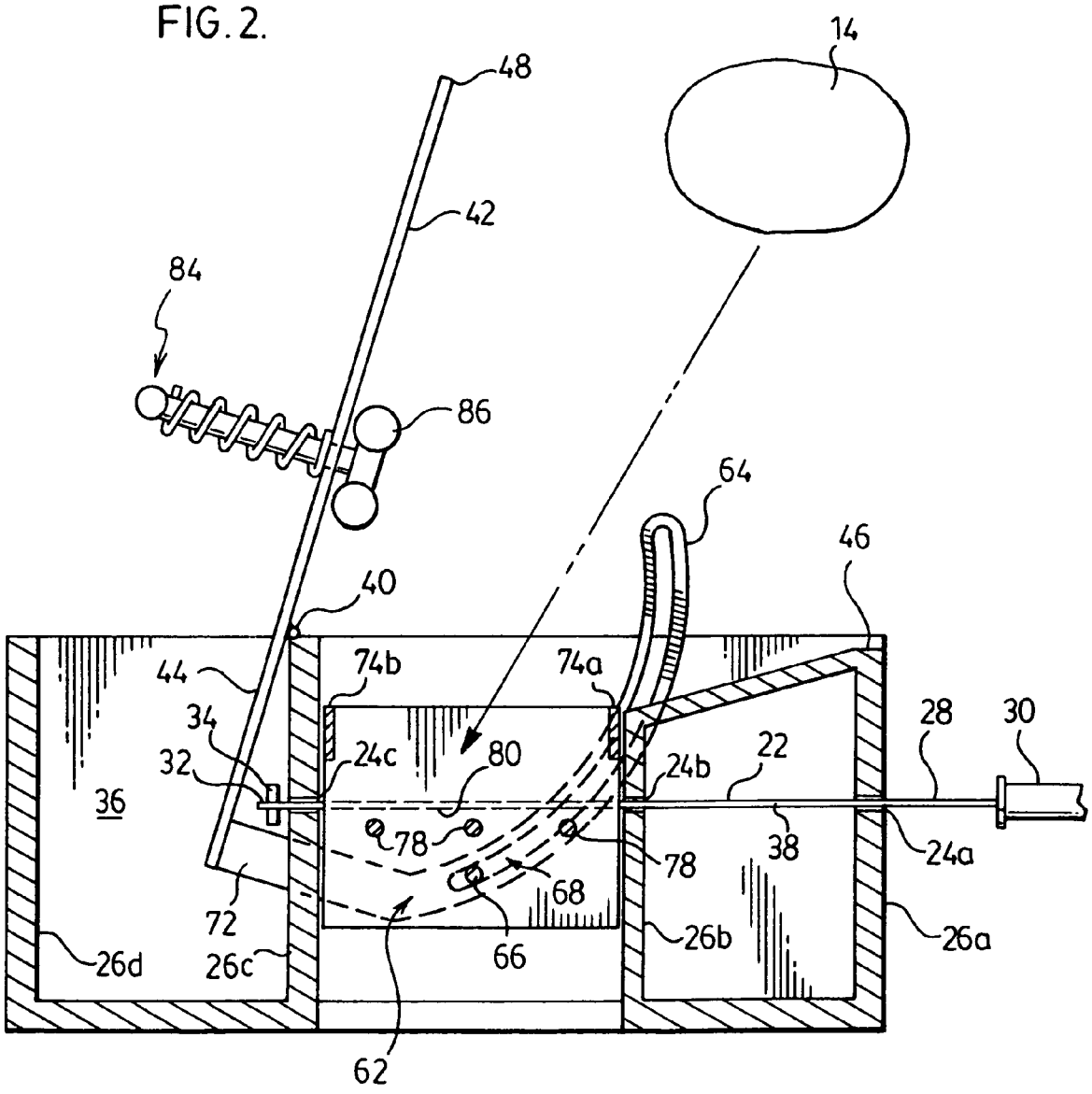
FIG. 2 is a cross-sectional view taken along the line 2—2 of FIG. 1.

A guide 20 is provided within the enclosure 12 for guiding a blade 22 to slice food 14 supported within the enclosure. As illustrated in FIG. 2 guide 20 is seen to be a series of slots in the outer and inner walls of the enclosure 12; the slots are aligned in a plane and, for the embodiment illustrated, extend along a substantially equal portion of the length of the enclosure. For the embodiment illustrated, and as best seen in FIG. 2, slot 24*a* is in outer wall 26*a*, slot 24*b* is in inner wall 26*b*, and slot 24*c* is in inner wall 26*c*. It can be appreciated that different arrangements of slots and enclosure walls are contemplated; so long as a guide that the blade can travel within is provided. For example, inner wall 26*b* and associated slot 24*b* can be removed, additional inner walls and associated slots can be provided, or outer wall 26*d* could be provided with an associated slot.

Figure 9:
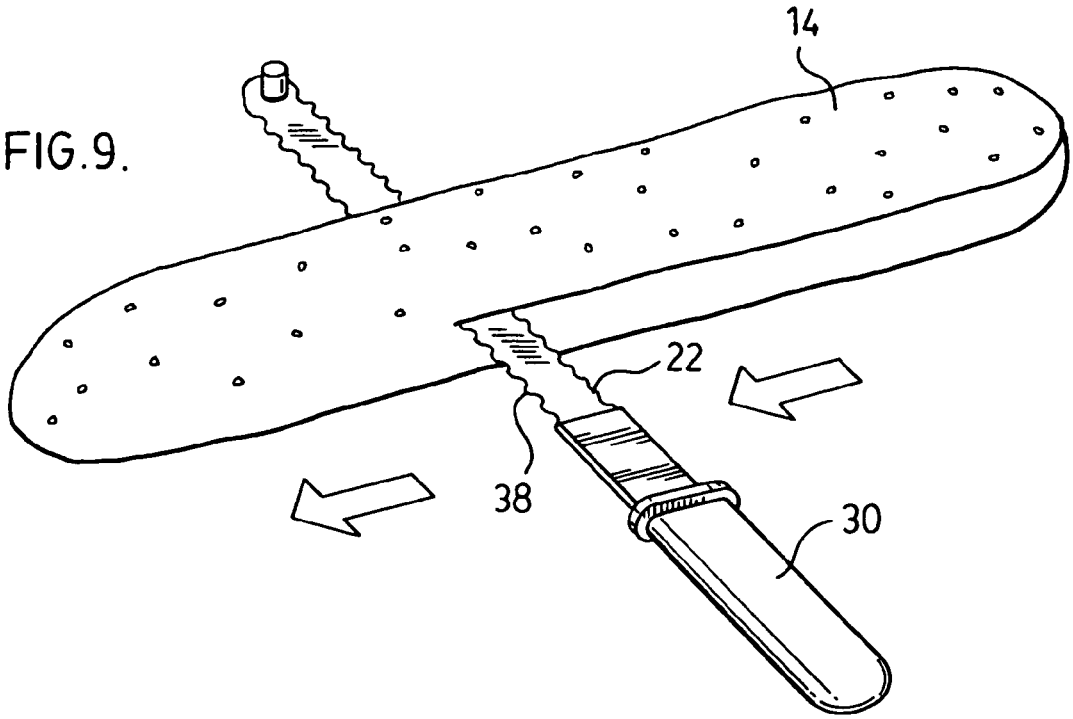
FIG. 9 is a part view showing the blade slicing bread.

As particularly illustrated in FIGS. 1 and 2, one end 28 of blade 22 extends outwardly of enclosure 12, and particularly outwardly of the enclosure along one side of guide 20 (i.e., through slot 24*a* and away from wall 26*a* for the embodiment illustrated). End 28 can be provided with a handle 30 that a user (not illustrated) can grasp. The other end 32 of the blade 22 (see FIG. 2) is provided with a blade stop 34 that is displaceable within a channel 36 provided along the other side of the guide (i.e., provided between inner wall 26*c* and outer wall 26*d* for the embodiment illustrated). Blade stop 34 stops end 32 of blade 22 from passing through slot 24*c*, and hence a user is prevented from removing the blade by pulling it out of the slot 20. Channel 36 is configured to allow blade 22 to travel within the guide 20 and allow for a limited cutting action as the blade 22 slices food 14 (see FIG. 9). It can be appreciated that the blade is fully operable to slice food, yet cannot be removed from the apparatus during normal use.

Moreover, channel 36, blade stop 34, and the extent of the knife-edge 38 along the blade 22 can be designed so that as the blade is traveling within guide 20 to slice food 14, knife-edge 38 of blade 22 is presented entirely within enclosure 12 (i.e., knife-edge 38 is stopped from passing through slot 24*a* to the outside of enclosure 12).

Figure 7:
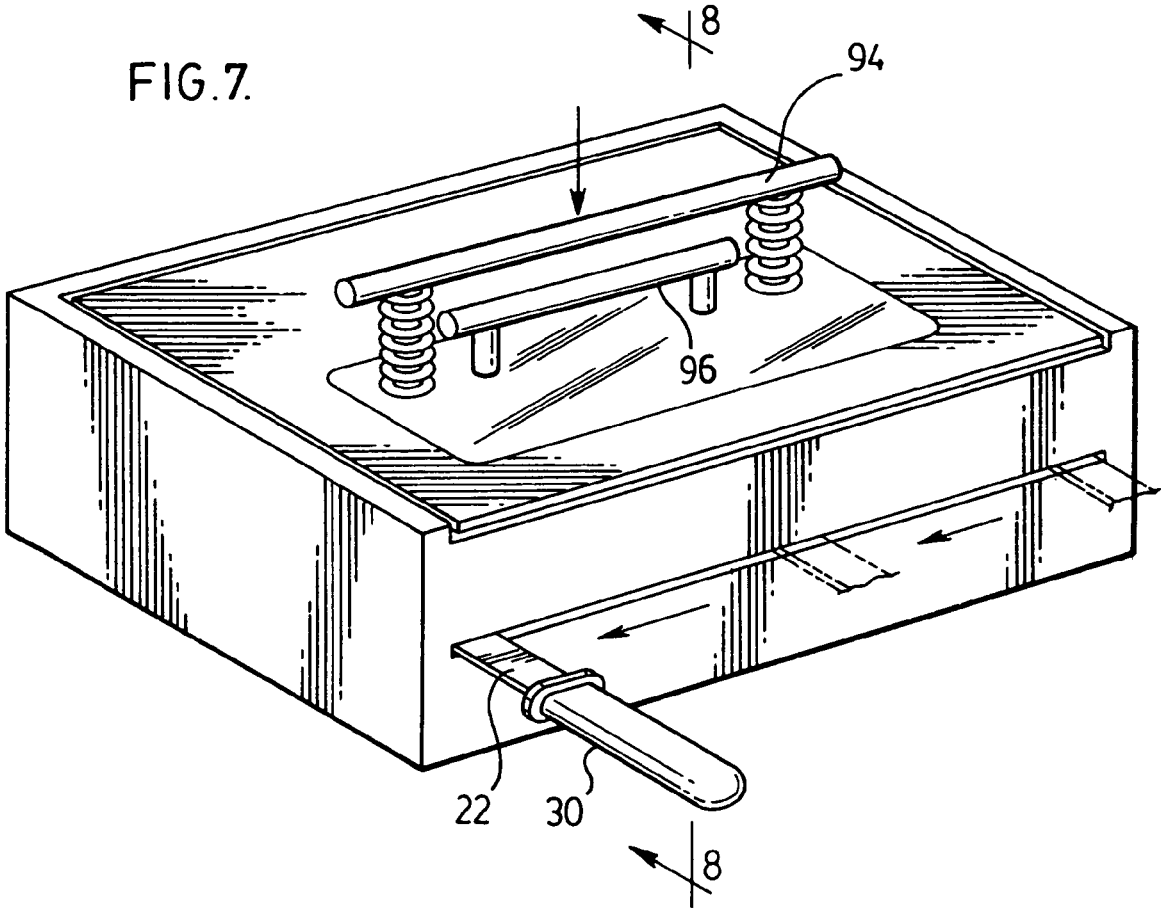
FIG. 7 is a perspective view showing the food slicing apparatus in use.

For the embodiment illustrated, cover 18 is pivotally attached to the enclosure 12 through a pivot 40 provided on inner wall 26*c*. By pivoting cover 18 as illustrated, a portion 42 of the cover can be moved to open or close enclosure 12 while a second portion 44 pivots into and out of channel 36. Outer wall 26*a* of enclosure 12 can be provided with a ledge 46 that the leading edge 48 of the cover 18 can fit within. The remaining edges of the cover 18 are sized to just fit within access opening 16 so that when the cover is in a closed position (as illustrated in FIG. 7) the access opening is substantially covered. Cover 18 can be provided with a window 50 to allow a user to look into enclosure 12 when the cover is closed. The window can be glass, plexiglass, or other suitable material.

To minimize or prevent exposure by a user to knife-edge 38 of the blade 22 when cover 18 is open, it is desirable to position the blade away from where food 14 is supported within enclosure 12 and stop the blade from being able to travel within the guide 20 along its longitudinal extent. A stop 52 is therefore provided to at least partially obstruct the guide 20 and stop the blade from traveling within the guide. Stop 52 as illustrated in FIGS. 1 and 2 is a block that is sized to move within a channel provided between inner walls 26*b* and 26*c*. It can be appreciated, however, that other shapes and arrangements for the stop can be provided to stop the blade 22 from traveling within the guide 20.

To position the stop 52 in place so that it stops the blade 22, the guide and the stop 52 are moveable relative to one another. In particular, when the cover 18 is in an open position, the stop should at least partially obstruct the guide 20 to block movement of the blade within the guide beyond the stop (see, for example, FIGS. 1 and 5). In the embodiment disclosed, stop 52 is connected to cover 18 so that it moves relative to guide 20 to at least partially obstruct the guide when the cover is in the open position, as will hereinafter be described.

Stop 52 is presented near at least one end of guide 20. In the embodiment disclosed, stop 52 is presented near each end 54*a* and 54*b* of the guide; in other words, two stops, 52*a* and 52*b*, respectively, are provided. Further, stops 52*a* and 52*b* are spaced from the inside facings 56*a* and 56*b* of end walls 58*a* and 58*b* of enclosure 12*a* sufficient extent to define spaces 60*a* and 60*b* respectively, to retain the blade. Once the food has been sliced, the blade 22 can be moved to either one of spaces 60*a* and 60*b*. The cover is then opened, and the blade 22 is retained in the space by the respective stop 52*a* or 52*b*. In this manner blade 22 can be stopped or blocked from traveling within the guide where food 14 is supported within the enclosure 12.

A linkage assembly 62 can be provided to connect stop 52 to cover 18. Linkage assembly 62 includes a slotted arm 64, and, for the embodiment disclosed, slotted arm 64 is two curved slotted arms 64*a* and 64*b* provided at either side of the cover 18. Openings 65*a* and 65*b* are provided between each end or side of inner wall 26*c* and the inner facings 56*a* and 56*b* of end walls 58*a* and 58*b*, respectively, to allow the respective curved slotted arms 64*a* and 64*b* to move through. If necessary, similar openings (not illustrated) can be provided between inner wall 26*b* and the inner facings of the end walls. A pin 66 is provided by each stop 52*a* and 52*b* shaped to slide within the curved slotted portion 68 of the curved slotted arms 64*a* and 64*b*. A spacer 70 (see FIG. 4) can be provided over pin 66 between the stops and the slotted arms. An end 72 of the curved slotted arms 64*a* and

64*b* is connected to the cover 18, and particularly at either side of the rear portion 44 of the cover.

Figure 3:
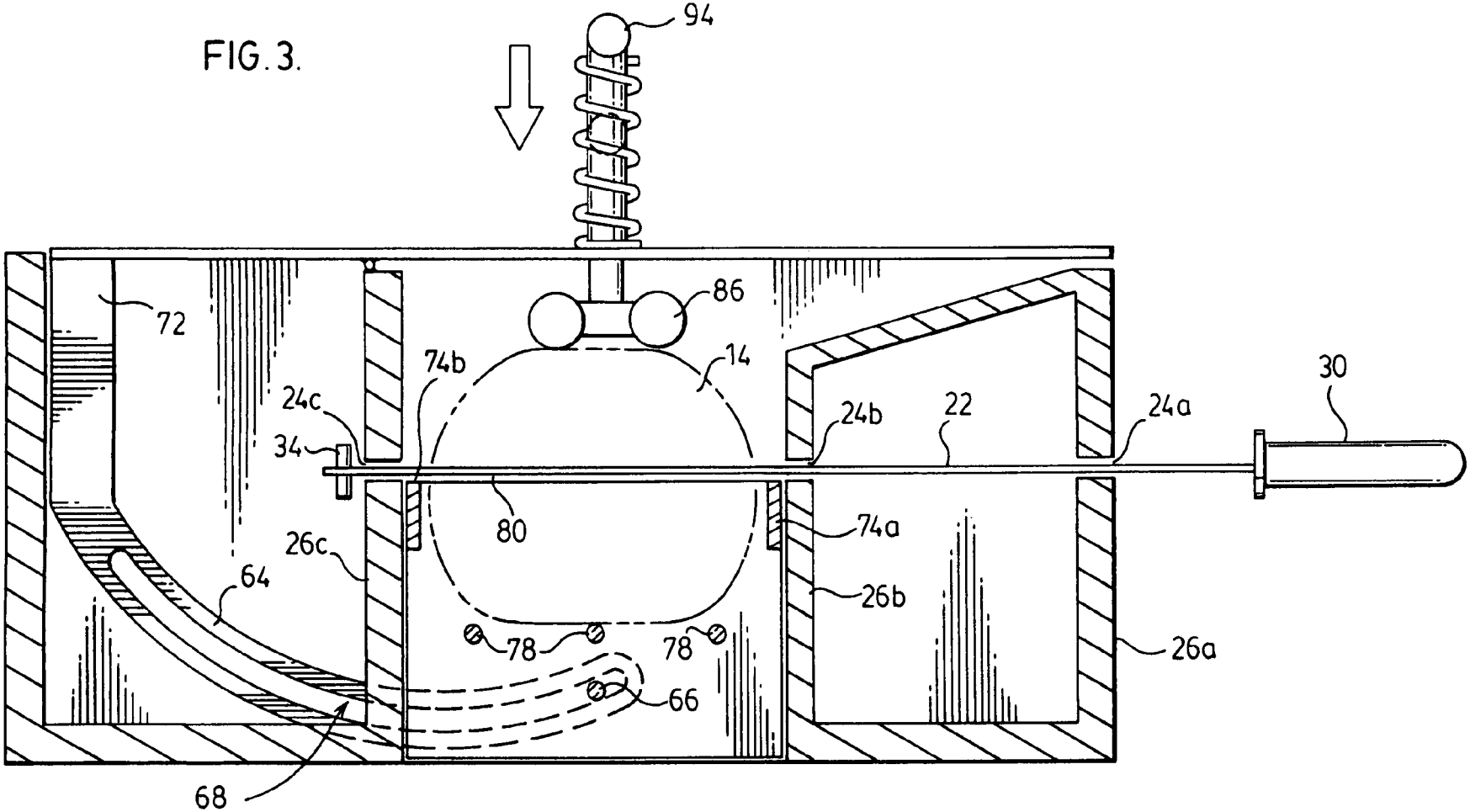
FIG. 3 is a cross sectional view similar to FIG. 2, but with the cover in a closed position showing the blade slicing a food item within the enclosure.

In operation, then, as cover 18 is pivoted about pivot 40 to an open position, rear portion 44 of the cover pivots into channel 36 of enclosure 12. As the rear portion 44 of the cover is connected to the curved slotted arms 64*a* and 64*b*, the arms move through respective opening 65*a* and 65*b*. Pin 66 of the respective stops 52*a* and 52*b* moves within the slot 68 of the arms from the position shown in FIG. 3 to the position shown in FIG. 2. This motion causes stops 52*a* and 52*b* to move relative to the guide 20 between inner walls 26*b* and 26*c* of enclosure 12 from a position that allows the blade to travel within the guide (see FIGS. 3 and 6) to a position where the stops at least partially obstruct the guide (see FIG. 2) and hence block travel of the blade within the guide (see FIG. 5).

It can be appreciated other arrangements for connecting the lid to displace the stop relative to the guide can be constructed without departing from the spirit and scope of this invention. For example, linkage assembly 62 could be in the form of arms that depend from the sides of front portion 42 of the cover 18 directly down into the channel between inner walls 26*b* and 26*c*, to connect to the respective stops. In this arrangement, as the cover is lifted the connecting arm directly lifts the respective stops upwardly in the channel between inner walls 26*b* and 26*c* so that they at least partially obstruct guide 20. Here, the connecting arms can be secured at either side of the front portion 42 of the cover 18 through appropriate pivotal connections to accommodate the change of orientation between the cover and the connecting arms as the cover is lifted to an open position. The connecting arms can also be pivotally connected to the respective stops, if desired.

It is also desirable to provide a food slicing apparatus that cannot be opened when the blade is used to slice food supported within the enclosure. For the embodiment illustrated, a contact surface 74 is provided to engage the blade 22. The cover can be connected to at least one of the contact surface and the guide to displace the contact surface and the guide relative to one another so that as the cover is displaced to an open position the contact surface is displaced to at least partially cross the plane of the guide. In the embodiment disclosed, the cover is connected to the contact surface, as will hereinafter be described, to move the contact surface relative to the guide.

As illustrated, for example, in FIGS. 1 and 4 the contact surface 74 is connected to the stop 52, and, particularly, extends between stops 52*a* and 52*b*. Moreover, the contact surface 74 is part of a support structure 76 within enclosure 12 that supports food 14 to be sliced. In particular, support structure 76 is in the form of a cradle, and the contact surface forms the sides 74*a* and 74*b* of the cradle. The ends of the cradle are formed by stops 52*a* and 52*b*. A lower support surface 78 is formed by rods extending between stops 52*a* and 52*b*. It can be appreciated that other structures can form the lower surface, however, it is desirable to provide spacing within the lower support surface sufficient to allow food particles to fall through to the bottom of the enclosure for later disposal.

In operation, then, and as previously discussed, stops 52*a* and 52*b* do not obstruct the guide when cover 18 is in a closed position, and the blade 22 can travel within the guide to slice food supported by the support structure 76. When the blade is in use, should a user attempt to pivot cover 18 about pivot 40 to an open position, for the embodiment illustrated, curved slotted arms 64*a* and 64*b* move through opening 65*a* and 65*b*, and pin 66 will attempt to move within the slot 68 from a position shown in FIG. 3 to the position shown in FIG. 2. However, as previously discussed, this motion will begin moving the stops 52*a* and 52*b* to the position that blocks guide 20. This, in turn, by virtue of the construction disclosed, causes the cradle, and hence the contact surfaces 74*a* and 74*b* to move across the plane of the guide, thereby bringing the contact surfaces in contact with the surface 80 of the blade 22. Therefore, further movement of the cradle is blocked and the cover is stopped from opening any further. In this manner, a user can be prevented from accessing the enclosure while the blade is used to slice food.

To further protect a user from the knife-edge 38 of the blade 22, a cover 82 (see FIG. 4) can be provided. Cover 82 particularly prevents a user from contacting the knife-edge 38 of the blade when the blade is in either of spaces 60*a* and 60*b* by covering these spaces from the top. Cover 82 can also be provided with a sloped portion 83 that can help direct food 14 placed within the enclosure 12 to the support structure 76.

A mechanism 84 (see FIG. 8) for holding the food 14 in place in the support structure 76 as it is being sliced is also disclosed. In particular, an abutting surface 86 is presented within the enclosure 12 and moveable relative to the enclosure to engage at least one side of food 14 supported within the enclosure. An actuator 88 is presented outside of the enclosure and connected to the abutting surface through suitable connecting members, such as, for example, posts 90*a* and 90*b*, as illustrated in FIG. 8. In the embodiment disclosed, the cover 18 of the apparatus provides for the actuator and the abutting surface. The actuator can be a compressible handle 94, biased through springs 92*a* and 92*b* to normally urge the handle away from the cover, and hence the abutting surface away from where food is supported within the enclosure. A grip 96, can be provided to aid a user in compressing handle 94, as best illustrated in FIG. 7 and 8.

It can appreciated that variations to this invention would be readily apparent to those skilled in the art, and this invention is intended to include those alternatives.

The invention claimed is:

1. A food slicing apparatus, comprising:

a) an enclosure to support therein food to be sliced, the enclosure having an access opening;

b) a guide for guiding a blade to slice food supported within the enclosure;

c) a stop to at least partially obstruct the guide;

d) a cover for the access opening, the cover moveable relative to the enclosure from an open position to a closed position; and e) a linkage assembly to connect the cover to at least one of the guide and the stop, the linkage assembly to displace the guide and the stop relative to one another as the cover moves relative to the enclosure from the open position to the closed position, so that when the cover is in an open position the stop at least partially obstructs the guide.

2. A food slicing apparatus according to claim 1, wherein the stop is presented near at least one end of the guide.

3. A food slicing apparatus according to claim 1, wherein the stop is at least two stops presented near each end of the guide.

4. A food slicing apparatus according to claim 2, wherein the stop is spaced from an inside wall of the enclosure a sufficient extent to retain therebetween the blade.

5. A food slicing apparatus according to claim 1, wherein the linkage assembly connects the stop to the cover.

6. A food slicing apparatus according to claim 5, wherein the linkage assembly comprises a slotted arm.

7. A food slicing apparatus according to claim 5, wherein the linkage assembly comprises a curved slotted arm having one end connected to the cover, and the stop presenting a pin for sliding fit within the curved slotted portion of the curved slotted arm.

8. A food slicing apparatus according to claim 1, wherein the guide guides the blade substantially in a plane to slice food supported within the enclosure.

9. A food slicing apparatus according to claim 8, further comprising a contact surface to engage the blade, the contact surface connected to the cover and moveable relative to the guide, so that as the cover is displaced to an open position the contact surface is displaced to at least partially cross the plane of the guide.

10. A food slicing apparatus according to claim 8, further comprising a contact surface to engage the blade, and wherein the cover is connected to at least one of the contact surface and the guide to displace the contact surface and the guide relative to one another, so that as the cover is displaced to an open position the contact surface is displaced to at least partially cross the plane of the guide.

11. A food slicing apparatus according to claim 10, wherein the contact surface is connected to the stop.

12. A food slicing apparatus according to claim 10, wherein the stop is at least two stops presented near each end of the guide, and the contact surface is connected to each stop and extends therebetween.

13. A food slicing apparatus according to claim 10, wherein the contact surface is part of a support with the enclosure to support food to be sliced.

14. A food slicing apparatus according to claim 13, wherein the support is in the form of a cradle and the contact surface forms the sides thereof.

15. A food slicing apparatus according to claim 1, further comprising an abutting surface presented within the enclosure and moveable relative thereto to engage at least one side of food supported within the enclosure so that the food can be sliced.

16. A food slicing apparatus according to claim 15, further comprising an actuator presented outside of the enclosure and connected to the abutting surface to displace the abutting surface relative to the enclosure.

17. A food slicing apparatus according to claim 16, wherein the actuator is biased to normally present the abutting surface away from where food is supported within the enclosure.

18. A food slicing apparatus according to claim 17, wherein the actuator is a compressible handle.

19. A food slicing apparatus according to claim 18, wherein the abutting surface and the actuator are provided by the cover.

20. A food slicing apparatus according to claim 1, wherein one end of the blade extends outwardly of the enclosure along one side of the guide.

21. A food slicing apparatus according to claim 20, wherein the end of the blade that extends outwardly of the enclosure is provided with a handle.

22. A food slicing apparatus according to claim 21, wherein the other end of the blade is provided with a blade stop that is slideable within a channel provided by the enclosure along the other side of the guide.

23. A food slicing apparatus, comprising:

a) an enclosure to support food therein to be sliced, the enclosure having an access opening;

b) a guide for guiding a blade substantially in a plane to slice food supported within the enclosure;

c) a contact surface to engage the blade;

d) a cover for the access opening, the cover moveable relative to the enclosure from an open position to a closed position; and e) a linkage assembly to connect the cover to at least one of the contact surface and the guide, the linkage assembly to displace the contact surface and the guide relative to one another as the cover moves relative to the enclosure from the open position to the closed position, so that as the cover is moved to the open position the contact surface is at least partially across the plane of the guide.

24. A food slicing apparatus according to claim 23, wherein the linkage assembly connects the contact surface to the cover.

25. A food slicing apparatus according to claim 24, wherein the linkage assembly comprises a curved slotted arm having one end connected to the cover, and the contact surface presenting a pin for sliding fit within the curved slotted portion of the curved slotted arm.

26. A food slicing apparatus according to claim 25, wherein the contact surface is part of a support with the enclosure to support food to be sliced.

27. A food slicing apparatus according to claim 26, wherein the support is in the form of a cradle and the contact surface forms the sides thereof.

* * * * *